US011097301B2

(12) United States Patent
Jessup et al.

(10) Patent No.: US 11,097,301 B2
(45) Date of Patent: Aug. 24, 2021

(54) APPARATUS FOR A LOW PRESSURE NON-CONTACT CLEANING OF A PAINT APPLICATOR

(71) Applicant: HAPPY DYNAMICS INC., Ennismore (CA)

(72) Inventors: Philip Jessup, Ennismore (CA); Eleanor Jessup, Ennismore (CA)

(73) Assignee: HAPPY DYNAMICS INC., Ennismore (CA)

( * ) Notice: Subject to any disclaimer, the term of this patent is extended or adjusted under 35 U.S.C. 154(b) by 77 days.

(21) Appl. No.: 16/461,494

(22) PCT Filed: Nov. 16, 2017

(86) PCT No.: PCT/CA2017/051369

§ 371 (c)(1),
(2) Date: May 16, 2019

(87) PCT Pub. No.: WO2018/090138

PCT Pub. Date: May 24, 2018

(65) Prior Publication Data

US 2019/0344302 A1 Nov. 14, 2019

Related U.S. Application Data

(60) Provisional application No. 62/423,359, filed on Nov. 17, 2016.

(51) Int. Cl.
*B05B 15/555* (2018.01)
*B08B 3/08* (2006.01)
(Continued)

(52) U.S. Cl.
CPC ..... *B05B 15/555* (2018.02); *B08B 3/08* (2013.01); *B08B 5/02* (2013.01); *B08B 7/04* (2013.01)

(58) Field of Classification Search
CPC .... B08B 3/02; B08B 3/04; B08B 3/08; B08B 7/04; B08B 5/02; B08B 9/021;
(Continued)

(56) References Cited

U.S. PATENT DOCUMENTS 4,830,882 A * 5/1989 Ichinose ..... B05B 15/557 427/424
7,467,634 B2 12/2008 Jessup et al.
(Continued)

FOREIGN PATENT DOCUMENTS

CA 2507043 A1 9/2004
CA 2866038 A1 2/2007
(Continued)

OTHER PUBLICATIONS

ISA/CA, International Search Report and Written Opinion, dated Feb. 1, 2018, re PCT International Patent Application No. PCT/CA2017/051369.
(Continued)

*Primary Examiner* — David G Cormier
(74) *Attorney, Agent, or Firm* — Perry + Currier Inc.

(57) ABSTRACT

A non-contact cleaner for a paint spray equivalent having a housing with an open top with a venturi opening. A ring is contained the housing in a space downwardly from the entry opening thus forming a chamber between the ring and the venturi opening adapted to receive the paint spray tip to be cleaned. A plurality of circumferently spaced air nozzles created downward airflow through the housing while a solvent nozzle contained in the housing sprays solvent onto the paint tip to be cleaned.

7 Claims, 4 Drawing Sheets

(51) Int. Cl.
*B08B 5/02* (2006.01)
*B08B 7/04* (2006.01)

(58) Field of Classification Search
CPC ..... B08B 9/023; B44D 3/006; B05B 15/555; A47L 15/0065; A47L 15/0089
See application file for complete search history.

(56) References Cited

U.S. PATENT DOCUMENTS

| | | | |
|---|---|---|---|
| 9,221,068 | B2 | 12/2015 | Jessup et al. |
| 2008/0011333 | A1 | 1/2008 | Rodgers et al. |

FOREIGN PATENT DOCUMENTS

| | | | |
|---|---|---|---|
| CN | 101537400 | A | 9/2009 |
| DE | 10129667 | A1 | 1/2003 |
| DE | 102014006647 | A1 | 11/2015 |
| EP | 3551346 | A1 | 10/2019 |
| JP | S63123458 | A | 5/1988 |
| JP | 2004024950 | A | 1/2004 |

OTHER PUBLICATIONS

PCT/CA2017/051369, Apparatus for a Low Pressure Non-Contact Cleaning of a Paint Applicator, Nov. 16, 2017.

* cited by examiner

APPARATUS FOR A LOW PRESSURE NON-CONTACT CLEANING OF A PAINT APPLICATOR

CROSS-REFERENCE TO RELATED APPLICATIONS

This application claims priority of U.S. Provisional Application 62/423,359 filed Nov. 17, 2016, which is incorporated herein by reference.

FIELD OF THE INVENTION

The present invention relates to industrial painting equipment.

DESCRIPTION OF THE PRIOR ART

Industrial painting equipment is widely used throughout many different industries, such as the automotive industry. For example, robots manipulate paint applicators in the automotive industry in order to paint automotive vehicles as well as components for those vehicles.

In many applications, it is desirable, indeed oftentimes required, to clean the shroud and spray tip of the paint applicator painting between the spraying operations. Otherwise, accumulated paint on the applicator can result in paint drip, uneven spray patterns, as well as aesthetic defects. When this happens, it is oftentimes necessary to completely remove the paint sprayed onto the article and then repaint the entire article. That, however, is a costly and time-consuming procedure.

There have, however, been previously known devices for cleaning the applicators of painting equipment of the type that are manipulated by robots. For example, U.S. Pat. Nos. 7,467,634 and 9,221,068 both disclose a non-contact device for cleaning the spray tip of a robotic paint sprayer. In these previously known devices, the paint spray tip is inserted through an opening at the top of a housing and then sprayed with solvent for the paint. After spraying, drier air is discharged on the paint spray tip in order to dry the paint spray tip. In addition, downdraft nozzles contained within the housing create a downdraft or partial vacuum within the housing to draw air flow down through the opening on the top of the housing and across the paint spray tip being cleaned.

These previously known devices for non-contact cleaning the paint applicator have proven entirely adequate when used with solvent-based paints. For such solvent-based paints, the drier air flow has proven more than satisfactory to completely dry the paint spray tip after cleaning the tip by the solvent.

However, due primarily to government regulations as well as other considerations, many industries have shifted from solvent-based paints to water-based paints. With these previously known devices for non-contact cleaning of the paint spray tips for the spray gun, the spray applicators are oftentimes not adequately cleaned and not adequately dried upon removal from the device. While adequate drying of the paint spray application may be achieved by increasing the cycle time for the non-contact cleaning device, such increased cycle time unacceptably increases the cycle time of the overall painting operations. This, in turn, increases the overall cost of the painting operation.

In order to reduce or eliminate the reliance upon solvent-based paints, water-based paints have enjoyed increasing acceptance in the automotive industry as well as other industries. Such water-based paints, of course, utilize water-based solvents, not organic solvents, as the cleaning medium. The use of water-based paints, however, presents special challenges for cleaning the spray shroud and spray tip between spraying operations.

First, the spray paint applicators for water-based paints oftentimes include a plurality of electrodes circumferentially spaced around the paint sprayer at its spraying end in order to improve the paint adhesion characteristics. These electrodes, however, closely surround the painting tip and interfere with the previously known methods for cleaning the paint tip after a spraying operation.

SUMMARY OF THE PRESENT INVENTION

The present invention provides an apparatus for non-contact cleaning of paint spray applicators for a paint applicator which overcomes the above-mentioned disadvantages of the previously known devices. In particular, the device of the present invention may be used to effectively clean spray tips for water-based paints.

In brief, the paint applicator cleaner of the present invention comprises a housing having an open top. A funnel assembly is positioned within the housing across its open top. Thereafter, a solvent ring assembly overlies and is secured to the open upper end of the funnel assembly. This ring assembly, furthermore, includes a circular opening which faces upwardly and is dimensioned to receive the paint applicator of a robotic painter.

At a position spaced downwardly from the upper end of the cone assembly, a venturi ring is positioned within and secured to the cone. This venturi ring thus forms a chamber in between the venturi ring and the upper end of the cone which receives a portion of the paint spray tip. A plurality of circumferentially spaced air nozzles are positioned within this chamber directed toward the spray tip. Conversely, the spray tip at the end of the spray gun is positioned below the venturi ring.

A plurality of sprayers are contained within the cone beneath the venturi ring so that the output from the sprayer is directed towards the paint spray tip on the paint sprayer.

Air blowers are also contained within the cone so that the output from the air blower is directed down through the cone and away from the conical air and solvent ring assembly. This downward air spray draws the water based solvent, as well as any paint entrained within that water, downwardly through the cone for collection within the housing and subsequent disposal.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
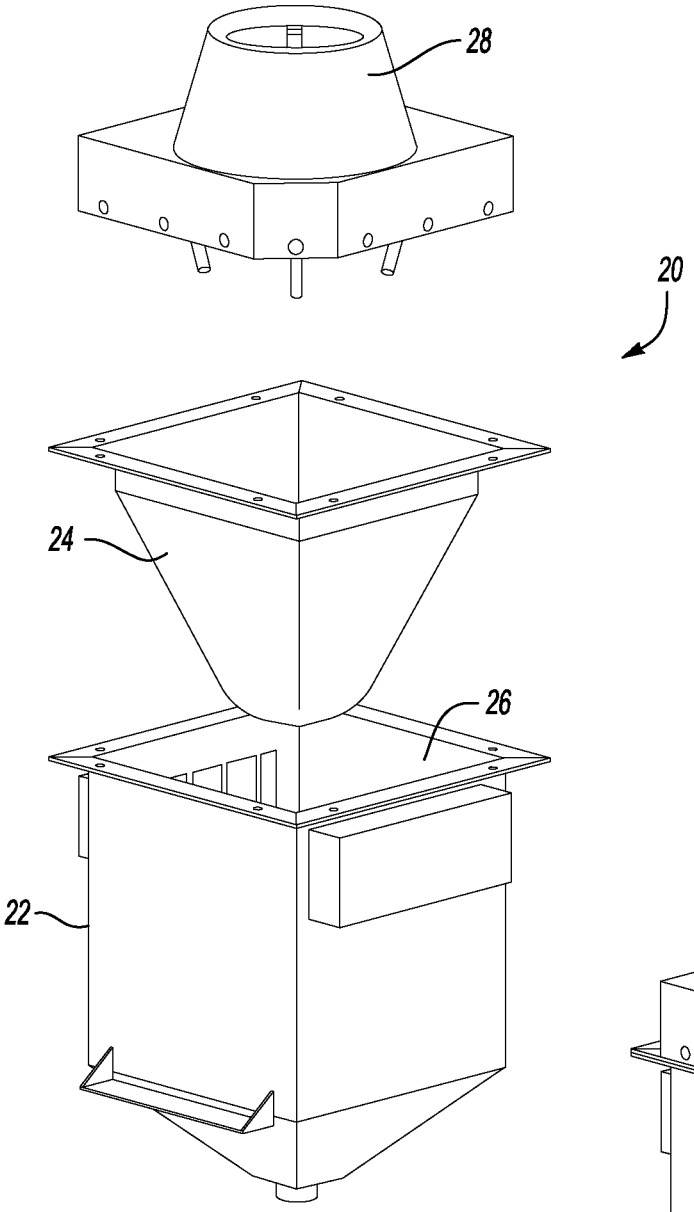
FIG. 1 is an elevational exploded view illustrating a preferred embodiment of the present invention.
Figure 2:
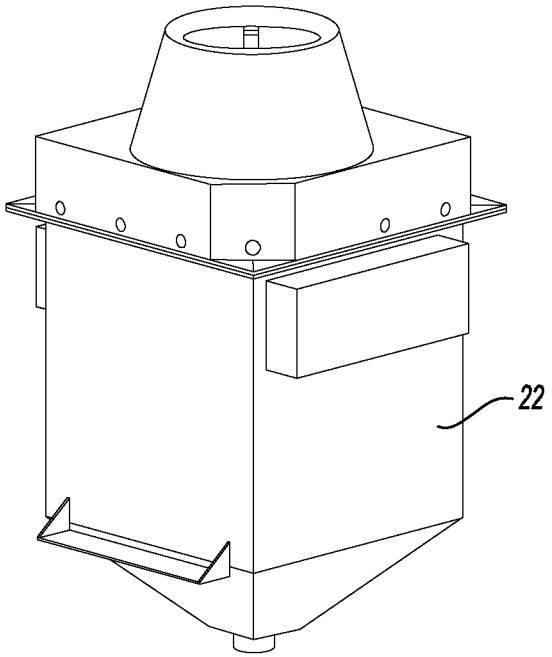
FIG. 2 is an elevational view of the preferred embodiment of the invention.

With reference first to FIGS. 1 and 2, a preferred embodiment of the cleaning apparatus 20 of the present invention is shown. The device 20 includes a base 22 which is generally rectangular in shape. A funnel assembly 24 is positioned in and overlies an open top 26 of the base 22. An air and solvent ring assembly 28 overlies the open top of the funnel 24.

With reference now to FIGS. 3-5 and 7, the air and solvent ring assembly 28 includes a conical support 30 having a circular venturi opening 32 at its top. A second venturi ring 34 having a central opening 36 is contained within the cone 30 at a position beneath the opening 32 thus forming a chamber 38 between the opening 32 and the venturi ring 36. Furthermore, both the opening 32 and opening 36 in the venturi ring 34 are dimensioned to receive the paint spray tip of an automatic paint spray robot therein.

Figure 3:
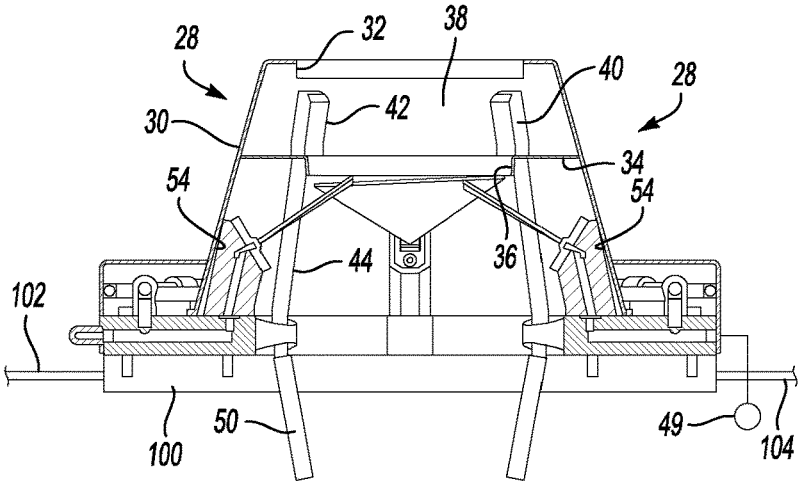
FIG. 3 is a partial sectional side view taken along line A-A in FIG. 5.
Figure 4:
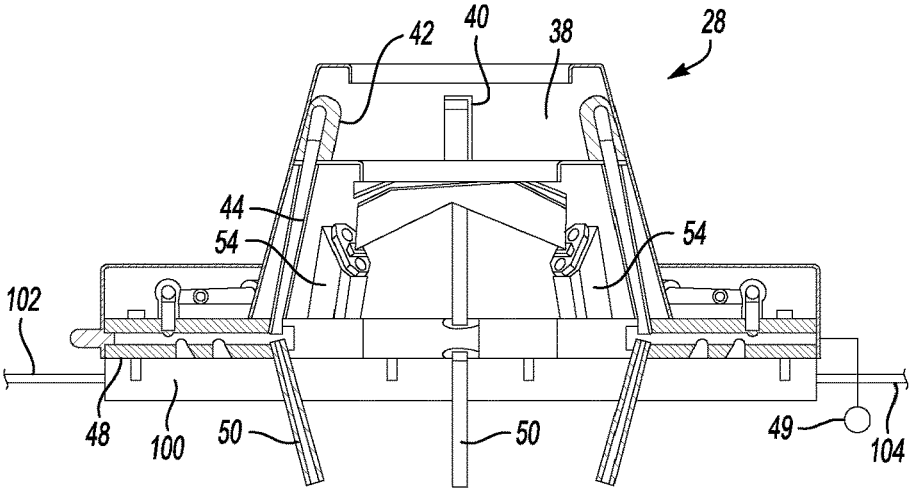
FIG. 4 is a sectional view taken along line B-B in FIG. 5.
Figure 5:
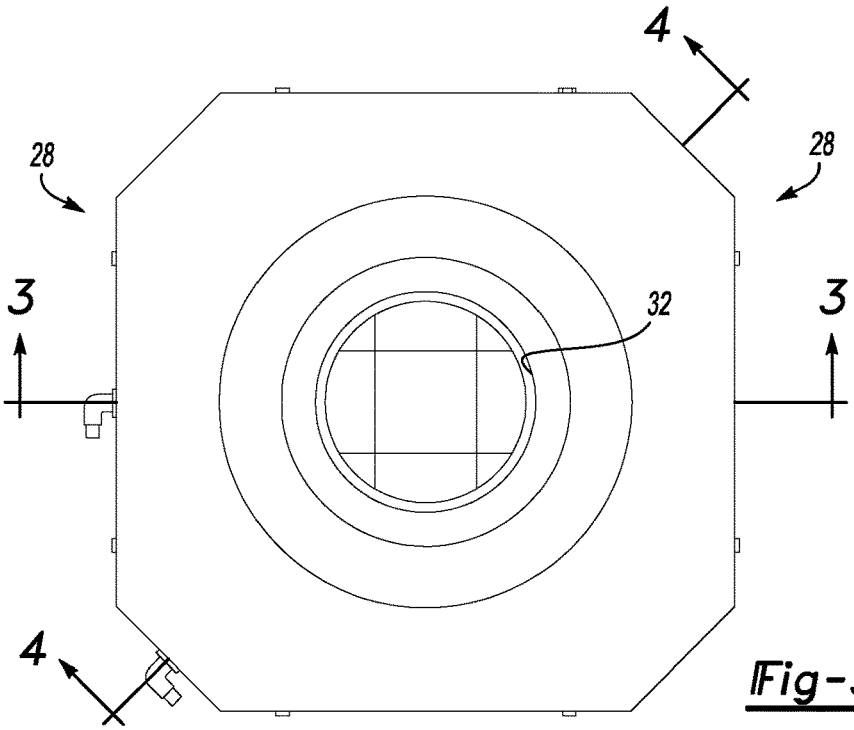
FIG. 5 is a top view of the present invention.
Figure 6:
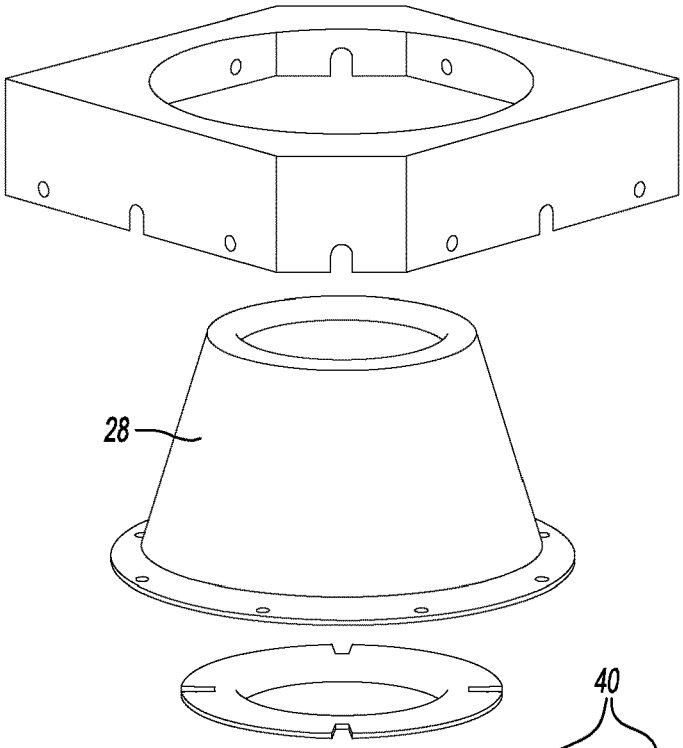
FIG. 6 is an exploded view illustrating an upper portion of the cleaning device of the present invention.
Figure 7:
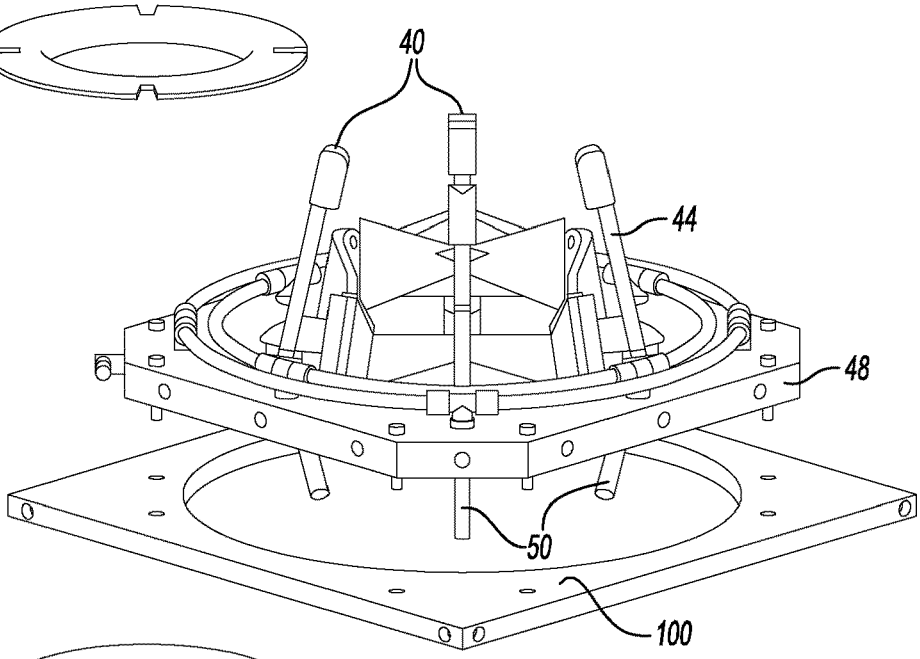
FIG. 7 is an elevational perspective view with parts removed illustrating the upper portion of the cleaning device of the present invention.
Figure 8:
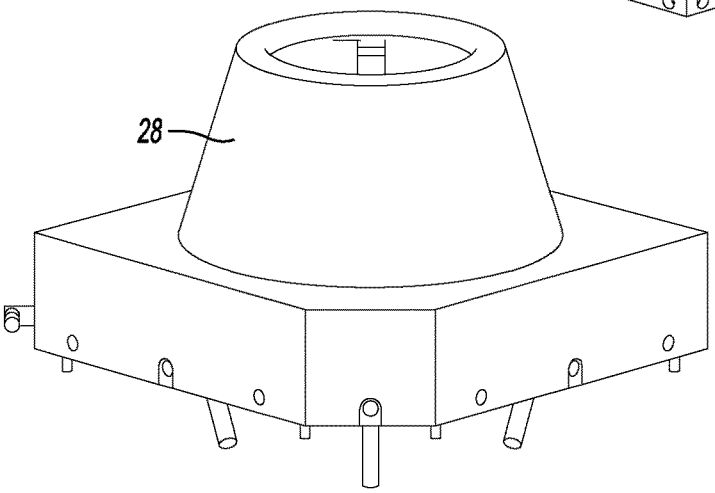
FIG. 8 is an elevational view of the upper portion of the present invention.

As best shown in FIGS. 3, 4, and 7, a plurality of air spray assemblies 40 each have an air spray nozzle 42 positioned within the chamber 38. The spray nozzles 42 are fluidly connected by pipes 44 to an air pressure distributor 48 extending around the bottom of the venturi ring 28. The air pressure distributor 48 is fluidly connected to an air pressure source and is also fluidly connected to a plurality of circumferentially spaced and downwardly extending air nozzles 50 which are contained within the interior of the funnel 24 and face downwardly through the funnel 24.

Still referring to FIGS. 3 and 4, the pressurized air supply 48 is also fluidly connected to a plurality of circumferentially spaced solvent spray nozzles 54 contained within the cone assembly 28. As perhaps best shown in FIG. 3, these nozzles 54 are oriented to direct their fluid spray at a position just below opening 36 in the venturi ring 34.

In order to increase the efficiently of drying, a heat exchanger 100 underlies and is in contact with the air pressure distribution 48. The heat exchanger 100 has a fluid inlet 102 and outlet 104 and heated water is preferably used as the fluid. Consequently, in opposition, the heat echanger 100 heats the air flowing through the pipes 44 and 50 to facilitate drying.

Figure 9:
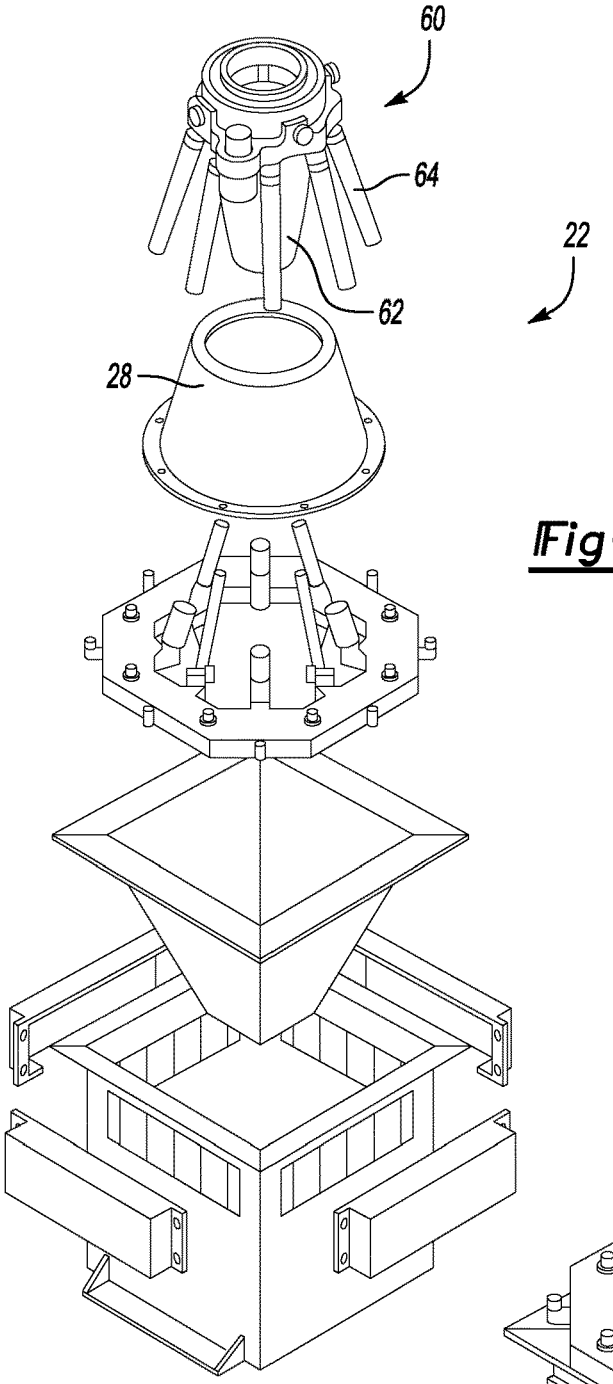
FIG. 9 is an exploded view illustrating the preferred embodiment of the present invention.
Figure 10:
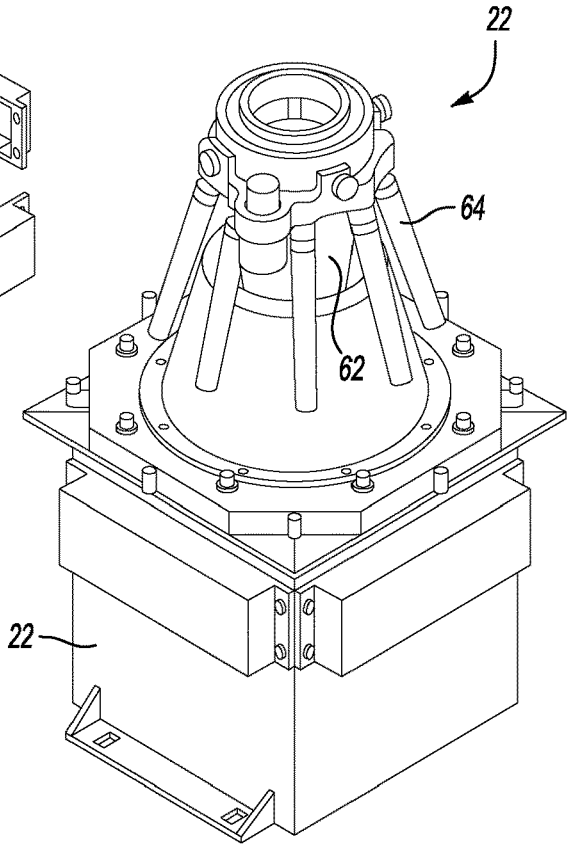
FIG. 10 is an elevational perspective view of the present invention.

FIGS. 9 and 10 are also exploded views and unexploded views illustrating the construction of the device 22 of the present invention. An exemplary paint applicator 60 is shown in FIG. 9. which includes the shroud and paint spray tip 62 as well as a plurality of circumferentially spaced electrostatic rods 64. Once the nozzle 62 is lowered through the opening 36 in the venturi ring 34, these electrodes 64 are positioned outside, as shown in FIG. 10, of the cone 28 and thus insulated from the cleaning operation.

In practice, following a spraying operation, a robot moves the paint applicator so that it is positioned within the opening 32 (FIG. 3) opening 36 in the venturi ring 34. At that time, pressurized air from the nozzles 40 not only dries the upper portion (as viewed in FIG. 3) of the paint applicator, but also prevents the water-based solvent from the fluid sprays 54 from entering into the chamber 38 above the venturi ring 34.

Simultaneously, pressurized water-based solvent from the four sprayers 54 sprays the tip of the paint sprayer thus removing any paint from the paint spray tip. Simultaneously, the air flow through the tubes 50 draws the water together with any entrained paint downwardly through the funnel 24 (FIG. 1) and into a bottom collection area in the housing 22.

After the tip has been cleaned of paint, water-based solvent spray from the nozzle 54 is terminated and the end of the paint applicator is slowly lifted upwardly and out of the ring assembly 28. Furthermore, the speed of withdrawal of the now cleaned painting tip from the housing 28 will preferably be sufficiently slow so that the air flow from the nozzles 40 completely dries the paint applicator before it is finally removed from the ring assembly 28.

A prime advantage of the present invention is that is can clean both the shroud and spray tip of the paint applicator. Furthermore, when changing paint colors, the old color paint can be completely purged from the applicator. Furthermore, the funnel and housing create a baffle where the air is able to escape and the solvent is stripped out and drains down for collection. The baffle, the vent and the funnel make up the "integrated media separator".

In view of the foregoing, it can be seen that the present invention provides an effective apparatus for cleaning the spray tip in an automated paint spraying operation. Having described my invention, however, many modifications thereto will become apparent to those skilled in the art to which it pertains without deviation from the spirit of the invention as defined by the scope of the appended claims.

We claim:

1. A non-contact cleaner for paint spray equipment comprising a conical support having an open top with a first opening, a ring having a second opening, the ring contained within said conical support and spaced downwardly from said first opening thus forming a chamber between said ring and said first opening, said chamber being adapted to receive a paint spray tip to be cleaned, a plurality of circumferentially spaced first air nozzles positioned within said chamber, a source of pressurized air fluidly connected to said first air nozzles, at least one solvent nozzle contained in said conical support below said second opening, said at least one solvent nozzle being directed towards said paint spray tip when the paint spray tip is positioned in said chamber, a source of pressurized paint solvent fluidly connected to said at least one solvent nozzle.

2. The non-contact cleaner of claim 1 wherein said first and second openings are circular in shape.

3. The non-contact cleaner of claim 1 and comprising a funnel assembly contained in said conical support and extending downwardly from said chamber.

4. The non-contact cleaner of claim 1 wherein said at least one solvent nozzle comprises a plurality of circumferentially spaced solvent nozzles.

5. The non-contact cleaner of claim 1 wherein said first air nozzles direct airflow downwardly away from said first opening.

6. The non-contact cleaner of claim 1 further comprising a plurality of circumferentially spaced second air nozzles being positioned below said paint spray, tip when the paint spray tip is positioned in said first and second opening and being arranged to direct airflow downwardly away from said paint spray tip when the paint spray tip is positioned in said first and second opening.

7. The non-contact cleaner of claim 3 comprising a plurality of circumferentially spaced second air nozzles positioned downwardly through the funnel assembly.

* * * * *